US011771153B1

(12) United States Patent
Otto

(10) Patent No.: US 11,771,153 B1
(45) Date of Patent: Oct. 3, 2023

(54) BATTER'S HAND GUARD

(71) Applicant: Wilson Sporting Goods Co., Chicago, IL (US)

(72) Inventor: Samuel J. Otto, Hermosa Beach, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 17/725,100

(22) Filed: Apr. 20, 2022

(51) Int. Cl.
*A41D 13/08* (2006.01)

(52) U.S. Cl.
CPC ..... *A41D 13/084* (2013.01); *A41D 13/088* (2013.01)

(58) Field of Classification Search
CPC ..... A41D 13/084; A41D 13/82; A41D 13/81; A61F 5/0118; A63B 71/14; A63B 71/143; A63B 71/145
See application file for complete search history.

(56) References Cited

U.S. PATENT DOCUMENTS 368,724 A * 8/1887 Loucks ..... A63B 71/143 D29/113
819,250 A * 5/1906 Paget ..... A63B 59/007 473/518
1,066,696 A * 7/1913 Baker ..... A63B 31/08 473/518
1,627,382 A * 5/1927 Golomb ..... A63B 71/145 2/18
1,714,648 A * 5/1929 Walker ..... A41D 13/082 2/164
2,309,476 A 1/1943 Patterson, Jr.
2,683,878 A * 7/1954 Davila ..... A41D 13/081 2/16
3,557,156 A 1/1971 Enneper et al.
3,890,649 A 6/1975 Diggins
3,900,024 A 8/1975 Lauber et al.
3,903,546 A * 9/1975 Rhee ..... A63B 71/145 2/18
3,923,049 A 12/1975 Lauber et al.
4,051,553 A 10/1977 Howard
4,235,228 A 11/1980 Gaylord et al.
4,279,344 A 7/1981 Holloway, Jr.
4,295,229 A 10/1981 Clark et al.
4,301,564 A 11/1981 Dalebout
4,400,829 A * 8/1983 Willis ..... A63B 71/148 D29/113
4,411,262 A 10/1983 von Bonin et al.
(Continued)

FOREIGN PATENT DOCUMENTS

GB 2055582 3/1981
GB 2200286 8/1988

*Primary Examiner* — Jillian K Pierorazio
(74) *Attorney, Agent, or Firm* — Terence P. O'Brien; Todd A. Rathe

(57) ABSTRACT

A batter hand guard may include a hand back portion configured to cover at least metacarpal bones of ring, middle and index fingers of the hand on the back side of the hand, a wrist back extension extending from the hand back portion and configured to cover a back of an ulna and a back of a radius of a forearm, and a wrist side extension extending sideways from the wrist back extension. The wrist side extension is formed from a moldable and hardenable material configured to wrap about the ulna from the back side to the palm side of the forearm.

23 Claims, 8 Drawing Sheets

(56) References Cited

U.S. PATENT DOCUMENTS 4,417,359 A * 11/1983 Johnson ..... A63B 71/145 D29/117.1
4,427,002 A 1/1984 Baron et al.
4,428,089 A 1/1984 Dawber et al.
4,433,494 A 2/1984 Courvoisier et al.
4,433,680 A 2/1984 Yoon
4,442,833 A 4/1984 Dahlen et al.
4,484,360 A 11/1984 Leighton et al.
4,502,479 A 3/1985 Garwood et al.
4,559,646 A 12/1985 Ertl
4,570,622 A 2/1986 von Bonin et al.
4,572,171 A 2/1986 Wegner et al.
4,598,429 A 7/1986 Mulvaney
4,676,861 A 6/1987 Bishop
4,690,932 A 9/1987 Mulvaney
4,701,963 A 10/1987 Overton
4,770,299 A 9/1988 Parker
4,832,010 A 5/1989 Erman
4,837,884 A 6/1989 Hilgarth
4,843,651 A 7/1989 Gramza et al.
4,864,660 A 9/1989 Sawyer
4,869,046 A 9/1989 Parker
4,964,229 A 10/1990 Laberge
4,966,134 A 10/1990 Brewer
5,003,970 A 4/1991 Parker et al.
5,027,803 A 7/1991 Scholz et al.
5,117,509 A 6/1992 Bowers
D327,754 S 7/1992 Hochgesang et al.
5,183,263 A 2/1993 Kuebler
5,295,269 A * 3/1994 Ballard ..... A41D 19/01523 2/161.1
5,316,294 A 5/1994 Turangan
5,335,916 A 8/1994 Nee
5,364,580 A 11/1994 Prent
5,425,701 A 6/1995 Oster et al.
5,511,248 A 4/1996 Widdemer
5,517,694 A 5/1996 Fabry
5,537,692 A 7/1996 Dorr
5,480,376 A 8/1996 Duback et al.
5,544,663 A 8/1996 Duback
5,598,582 A 2/1997 Andrews et al.
5,608,912 A 3/1997 Cumberland
5,636,381 A 6/1997 Brogden
5,637,077 A 6/1997 Parker
D381,129 S * 7/1997 Lawrence ..... D29/115
5,665,056 A 9/1997 Nakasugi et al.
5,692,242 A 12/1997 Tekerman et al.
5,708,979 A 1/1998 Redwood et al.
5,727,257 A 3/1998 Chen
5,732,713 A 3/1998 Duback et al.
5,745,919 A 5/1998 Kraatz
5,755,678 A 5/1998 Parker et al.
5,802,614 A 9/1998 Melone, Jr.
5,806,091 A 9/1998 McHugh
5,833,637 A 11/1998 Pong
5,867,830 A 2/1999 Chen
5,957,871 A 9/1999 Darcey
5,980,474 A 11/1999 Darcey
6,006,358 A 12/1999 Keating
6,022,331 A 2/2000 Darcey
6,044,494 A 4/2000 Kang
6,049,910 A 4/2000 McCarter
6,052,827 A 4/2000 Widdemer
6,065,155 A 5/2000 Sandusky
6,105,162 A 8/2000 Douglas
6,128,777 A * 10/2000 Foreman ..... A41D 13/08 602/8
6,182,293 B1 2/2001 Mustin
6,185,747 B1 2/2001 Hughes
6,223,353 B1 5/2001 Lardieri, Jr.
6,253,382 B1 7/2001 Kleinert
6,408,442 B1 6/2002 Kang
6,457,181 B1 10/2002 Grundy
6,526,593 B2 3/2003 Sajovic
6,539,550 B1 4/2003 Flores
6,745,402 B2 6/2004 Caswell
6,745,403 B2 6/2004 Sajovic
6,912,731 B2 7/2005 Cass
6,964,063 B2 11/2005 Bamber
7,210,172 B2 5/2007 Adams, Jr.
7,293,296 B1 11/2007 Beraznik et al.
7,487,553 B2 2/2009 Price
7,669,251 B2 3/2010 Hammons et al.
7,966,670 B2 6/2011 Wilbert et al.
8,191,174 B2 6/2012 Winningham et al.
8,225,426 B2 7/2012 Bevier
8,225,427 B2 7/2012 Bevier
8,239,969 B2 8/2012 Fisher
8,241,705 B2 8/2012 Sha
8,256,028 B1 9/2012 Ibon et al.
8,266,719 B2 9/2012 Duby
9,198,474 B1 12/2015 Hacobian
9,237,773 B2 * 1/2016 Perlmutter ..... A41D 13/08
10,004,975 B2 6/2018 Clement
11,058,940 B2 7/2021 Gilday et al.
2003/0037364 A1 2/2003 Alber
2004/0025226 A1 2/2004 Jaeger
2004/0045074 A1 3/2004 Tremblay
2004/0060097 A1 4/2004 Bamber
2004/0068777 A1 4/2004 Wheelington, II
2004/0107476 A1 6/2004 Goldwitz
2005/0034213 A1 2/2005 Bamber
2006/0149180 A1 * 7/2006 Phelen ..... A63B 21/4025 602/5
2006/0264792 A1 * 11/2006 Bonn ..... A61F 5/0118 602/21
2006/0276735 A1 * 12/2006 Phelen ..... A63B 21/4025 602/21
2007/0174948 A1 8/2007 Robba
2007/0209097 A1 9/2007 Iacullo
2008/0010719 A1 1/2008 Hoelscher
2008/0104737 A1 * 5/2008 Shepherd ..... A61F 5/0118 2/161.1
2008/0229477 A1 9/2008 McGrough
2008/0271224 A1 11/2008 Wilbert et al.
2009/0077706 A1 3/2009 Prather
2009/0139007 A1 6/2009 Bevier
2009/0139010 A1 6/2009 Bevier
2010/0024095 A1 2/2010 Gellis
2010/0077526 A1 4/2010 Smeltzer
2010/0077532 A1 4/2010 Kettani
2010/0077533 A1 4/2010 Munda
2010/0081981 A1 * 4/2010 Cheng ..... A61F 5/0118 602/21
2010/0095428 A1 4/2010 Fisher
2010/0186140 A1 7/2010 Ramirez
2010/0269235 A1 * 10/2010 Parks ..... F41H 1/02 2/2.5
2010/0325777 A1 12/2010 Radakrishnan et al.
2011/0041235 A1 2/2011 Harris
2011/0113521 A1 5/2011 Bradford
2011/0214220 A1 9/2011 Parker
2011/0214221 A1 9/2011 Munda
2011/0258754 A1 10/2011 DuPont
2011/0296582 A1 12/2011 Bevier et al.
2012/0005580 A1 1/2012 Bevier et al.
2012/0011633 A1 1/2012 Van Hale
2012/0028738 A1 2/2012 Love
2012/0030855 A1 2/2012 Clark
2012/0030856 A1 2/2012 Bevier
2012/0042438 A1 2/2012 Ramirez
2012/0073029 A1 3/2012 Clark
2012/0090068 A1 * 4/2012 Glass ..... A41D 13/0543 156/196
2012/0159681 A1 6/2012 Gibby
2012/0227158 A1 6/2012 Ashworth et al.
2012/0204319 A1 8/2012 Gambordella
2012/0210485 A1 * 8/2012 Clement ..... A63B 71/145 2/20
2012/0227155 A1 9/2012 Brown
2012/0245503 A1 9/2012 DeVries
2012/0324623 A1 12/2012 Cabauy et al.
2013/0036523 A1 2/2013 Webster

(56) References Cited

U.S. PATENT DOCUMENTS

| | | | | |
|---|---|---|---|---|
| 2013/0061369 | A1 | 3/2013 | Lim | |
| 2013/0167281 | A1 | 7/2013 | Jennings | |
| 2013/0196798 | A1* | 8/2013 | Ochs | A63B 60/40 473/518 |
| 2013/0198920 | A1 | 8/2013 | Wittman | |
| 2013/0227755 | A1 | 9/2013 | Bisaillon | |
| 2013/0239291 | A1 | 9/2013 | Harris | |
| 2013/0283498 | A1 | 10/2013 | Hewitt | |
| 2015/0165302 | A1 | 6/2015 | Jaramillo et al. | |
| 2015/0314189 | A1 | 11/2015 | Le | |
| 2016/0270945 | A1* | 9/2016 | Tomblin | A61L 15/12 |
| 2016/0367881 | A1 | 12/2016 | Le | |
| 2017/0265535 | A1* | 9/2017 | Ledingham | A41D 13/081 |
| 2017/0282048 | A1 | 10/2017 | Wittman | |
| 2018/0193718 | A1 | 7/2018 | Gilday et al. | |
| 2018/0255849 | A1 | 9/2018 | Paquette et al. | |
| 2019/0014834 | A1* | 1/2019 | Ledingham | A41D 19/002 |
| 2019/0328570 | A1* | 10/2019 | Tomblin | A61L 15/12 |
| 2020/0405320 | A1 | 12/2020 | Kawamoto | |
| 2021/0007873 | A1 | 1/2021 | Frederick | |
| 2021/0052968 | A1 | 2/2021 | Ciaglia | |
| 2021/0378332 | A1 | 12/2021 | Tryner et al. | |
| 2022/0088464 | A1 | 3/2022 | Kawiya | |
| 2022/0212087 | A1 | 7/2022 | Kucharsky | |

* cited by examiner

BATTER'S HAND GUARD

BACKGROUND

In various sports, such as baseball and softball, a batter attempts to strike a thrown ball. During such times, the batter is vulnerable to being struck by an errant pitch.

Figure 1:
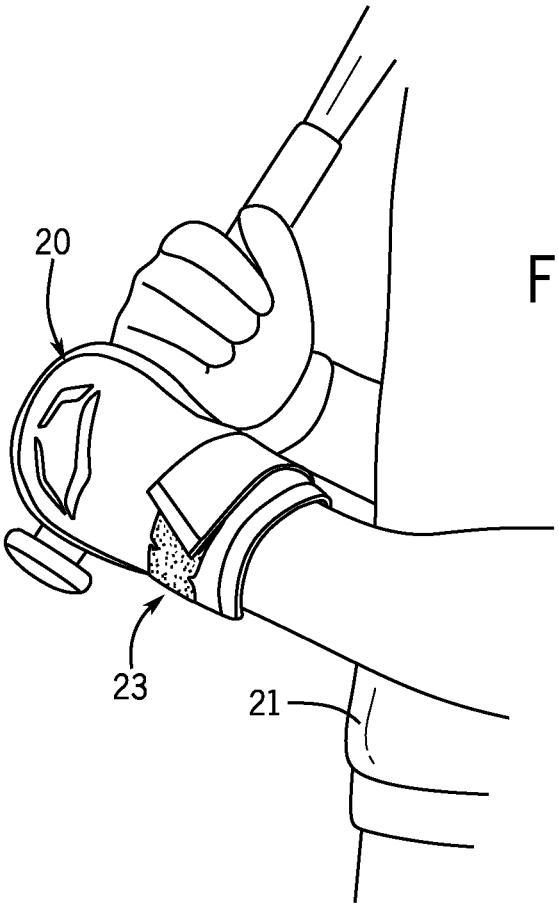
FIG. 1 is a fragmentary perspective view of a right-handed batter wearing an example batter hand guard.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example batter hand guards and methods for forming a batter hand guard. The example batter hand guards and methods protect the batter's hand and wrist from impacts from a thrown ball. The example batter hand guards and methods comprise a wrist side extension that extends about and covers a side of the wrist that is to face an oncoming thrown or pitched ball. The side of the wrist that faces an oncoming thrown ball is typically the side adjacent the ulna bone.

The wrist side extension is rigid and curved to receive the side of the wrist that is to face the oncoming thrown ball. In some implementations, the wrist side extension is preformed and has a predefined shape prior to ever being worn by the batter. In such implementations, the wrist side extension along with any other protective portions of the hand guard may be molded in a mold having a particular predefined shape for the wrist side extension, wherein the material hardens while within the mold. In some implementations, the wrist side extension is molded and hardened while in a mold, wherein once removed from the mold, may be encased by an outer flexible or breathable encasement, such as a fabric encasement. In such implementations, different batter hand guards having differently shaped wrist side extensions may be used by different batters having different wrist sizes or different preferences. The batter may select a particular hand guard having a particular wrist side extension shape that best matches his or her wrist or his or her preferences.

In some implementations, the wrist side extension is formed from a moldable and hardenable material and allows a batter to don (put on) the hand guard and wrap the wrist strap extension about the batter's wrist to form a customized shape prior to hardening of the hardenable material of the wrist strap extension. As a result, the wrist strap extension may be bent and deformed as it is wrapped about the ulna bone and the side of the batter's wrist. While wrapped about the side of the batter's wrist, the wrist strap extension may be hardened to fix or make permanent the customized curved profile of the wrist strap extension, providing an enhanced fit that is less susceptible to movement and misalignment, thereby offering greater protection for the batter. The customized shape of the wrist strap extension may additionally assist in the proper positioning and alignment of the batter hand guard on the hand of the batter during donning of the batter hand guard.

In some implementations, the batter hand guard may include a wrist strap or other mechanism to retain the wrist strap extension in a wrapped state about the batter's wrist while the hardenable material of the wrist strap extension hardens and becomes rigid. Once the wrist side extension has been hardened and becomes rigid, the wrist strap extension will retain its shape, customized for the particular batter. The wrist strap may further assist in retaining the batter hand guard on the batter's hand and adjacent the batter's wrist during use of the batter hand guard Regardless of whether the wrist side extension has a preformed or predefined rigid shape prior to ever being worn by the batter or is hardened while or after being initially worn by batter for a rigid shape customized to the batter, the resulting batter hand guard provides enhanced protection for the side of the batter's wrist facing an oncoming pitch. In such implementations, the batter hand guard may have a protective portion having an L-shape comprising a hand back portion, a wrist back extension extending from the hand back portion, and a wrist side extension extending sideways form the wrist back extension. The L-shape may be provided by a single unitary panel member or may be provided by multiple distinct individual panel members held in close proximity to one another. In those implementations where the L-shape is provided by multiple distinct individual panel members, some of the individual panel members, other than the panel member or members forming the wrist side extension, may be rigid and some panel members may be bendable or flexible. In some implementations, each of the individual panel members may be hard or rigid. In each of such implementations, the wrist side extension provides a rigid or hard shell that receives a side of the batter's wrist to protect the batter's wrist during a pitch.

Disclosed an example batter hand guard. The example batter hand guard may comprise a protective portion having an L-shape. For left-handed batters, the lower end of the L-shape, when viewed from the face that will not contact the batter's hand (the front side), projects to the left. For right-handed batters, the L-shape, when viewed from the face that will not contact the batter's hand, projects to the right. The L-shape of the protective portion may be formed by a hand back portion, a wrist back extension extending from the hand back portion, and a wrist side extension extending sideways form the wrist back extension. The example batter hand guard may further comprise a finger retainer connected to the hand back portion, and a wrist strap extending sideways from the wrist side extension for wrapping about a wrist, wherein wrist side extension is rigid and curved to receive a side of the wrist. In some implementations, the L-shape of the protective portion is formed from a single unitary panel member. In some implementations, the wrist side extension is formed from a moldable and hardenable material. In some implementations, the wrist side extension is substantially coplanar with the wrist back extension and the hand back portion prior to being molded and hardened while being wrapped about a batter's wrist.

Disclosed is an example batter hand guard. The example batter hand guard may include a hand back portion configured to cover at least metacarpal bones of ring, middle and index fingers of the hand on the back side of the hand, a wrist back extension extending from the hand back portion and configured to cover a back of an ulna and a back of a radius of a forearm, and a wrist side extension extending sideways from the wrist back extension. The wrist side extension is formed from a moldable and hardenable material configured to wrap about the ulna from the back side to the palm side of the forearm.

Disclosed is an example batter hand guard. The example batter hand guard may comprise a single unitary panel formed from a moldable and bendable material and having an L-shape. The panel may comprise a hand back portion, a wrist back extension extending from the hand back portion, and a wrist side extension extending sideways form the wrist back extension. The example batter hand guard may further comprise an encasement about the panel, a finger retainer connected to the encasement proximate an end of the hand back portion, and a wrist strap extending sideways from the wrist side extension for wrapping about a wrist. The wrist side extension is moldable for wrapping the wrist strap extension about a side of an anatomical wrist and is hardenable for retaining (making permanent) a wrapped shape corresponding to a shape of the wrist.

Disclosed is an example method for protecting the wrist of a batter. The method may comprise positioning a moldable panel over a back side of a batter's hand such that a hand back portion covers at least metacarpal bones of ring, middle and index fingers of the hand on the back side of the hand, such that a wrist back extension extending from the hand back portion covers a back of an ulna and a back of a radius of the forearm. The method may further comprise bending and wrapping a wrist side extension, extending from the wrist back extension, about a side and ulna of a wrist of the batter, wrapping a wrist strap, extending from the wrist side extension, about the wrist, and hardening the wrist side extension while the wrist strap is wrapped about the wrist.

FIG. 1 illustrates an example batter hand guard 20 being worn by a right-handed batter 21 during an at-bat. As shown by FIG. 1, batter hand guard 20 protects the batter's hand and wrist that will face an oncoming pitch. Batter hand guard 20 provides a protective hard shell which at least partially wraps about the ulna side 23 of the batter's wrist that will face an oncoming pitch.

Figure 2:
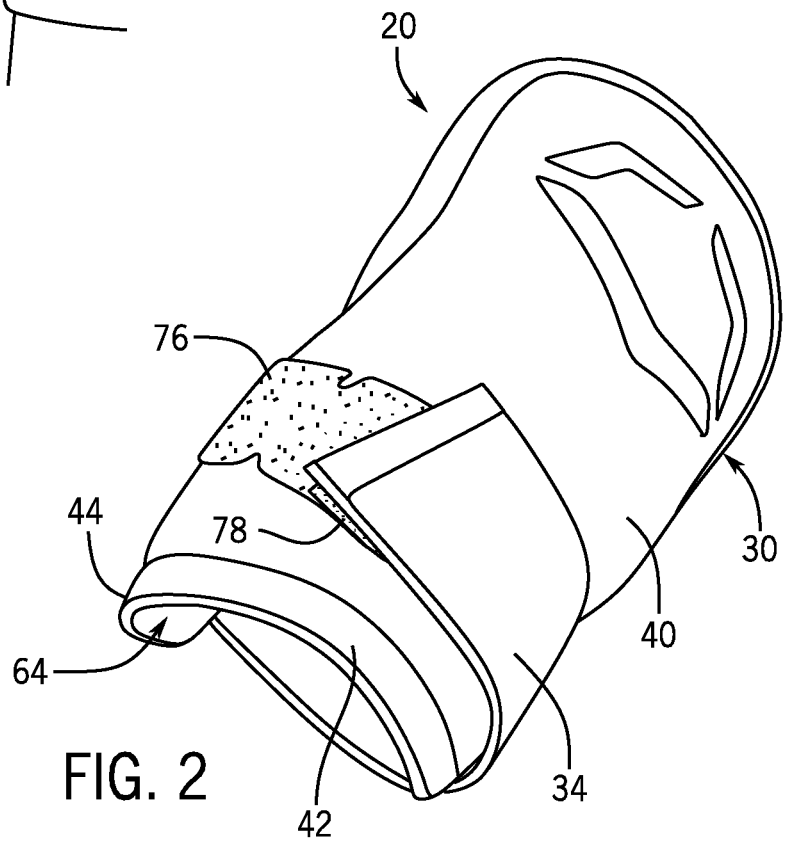
FIG. 2 is a perspective view of a front side of the batter hand guard of FIG. 1 in a closed state.
Figure 3:
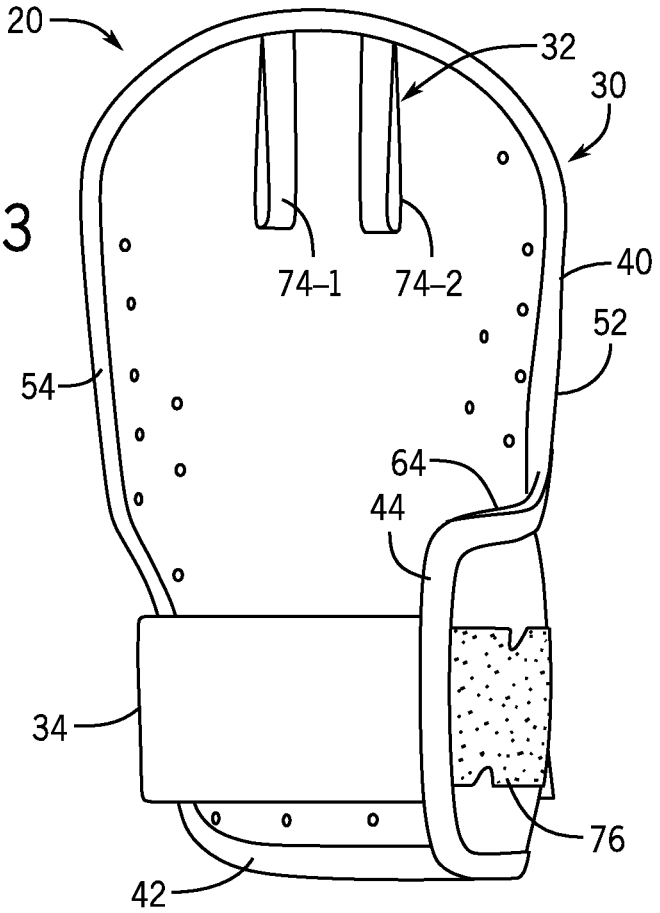
FIG. 3 is a perspective view of a backside of the batter hand guard of FIG. 2 in the closed state.
Figure 4:
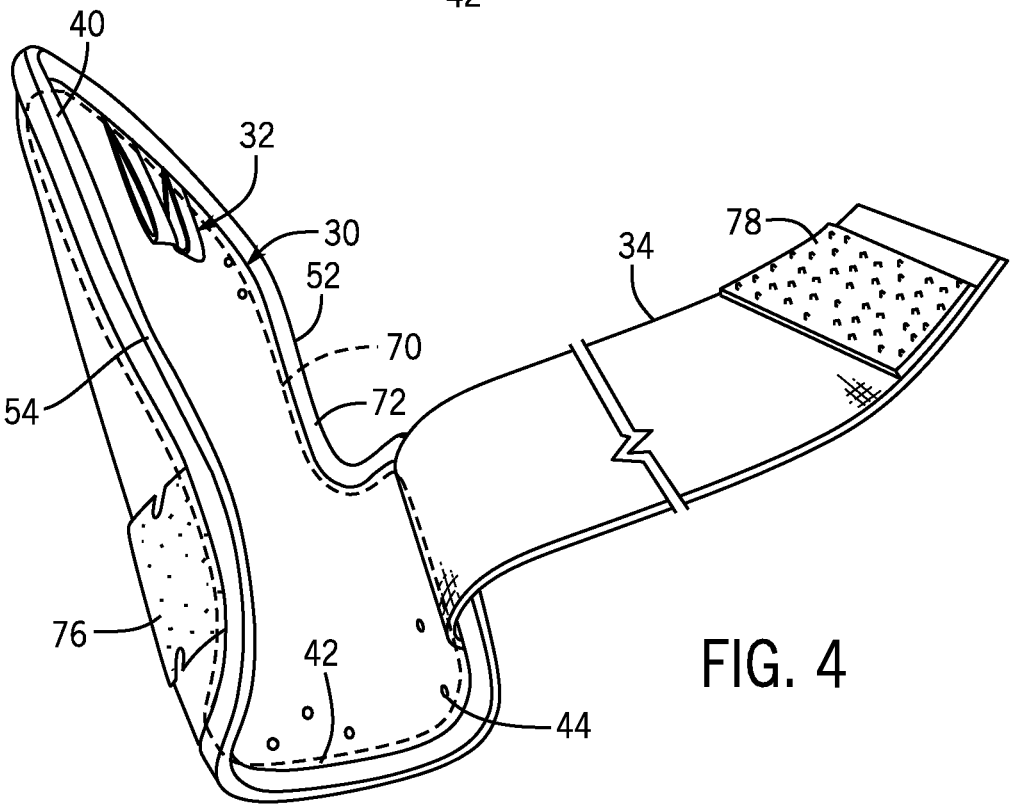
FIG. 4 is a perspective view of the backside of the batter hand guard of FIG. 3 in an opened state.
Figure 5:
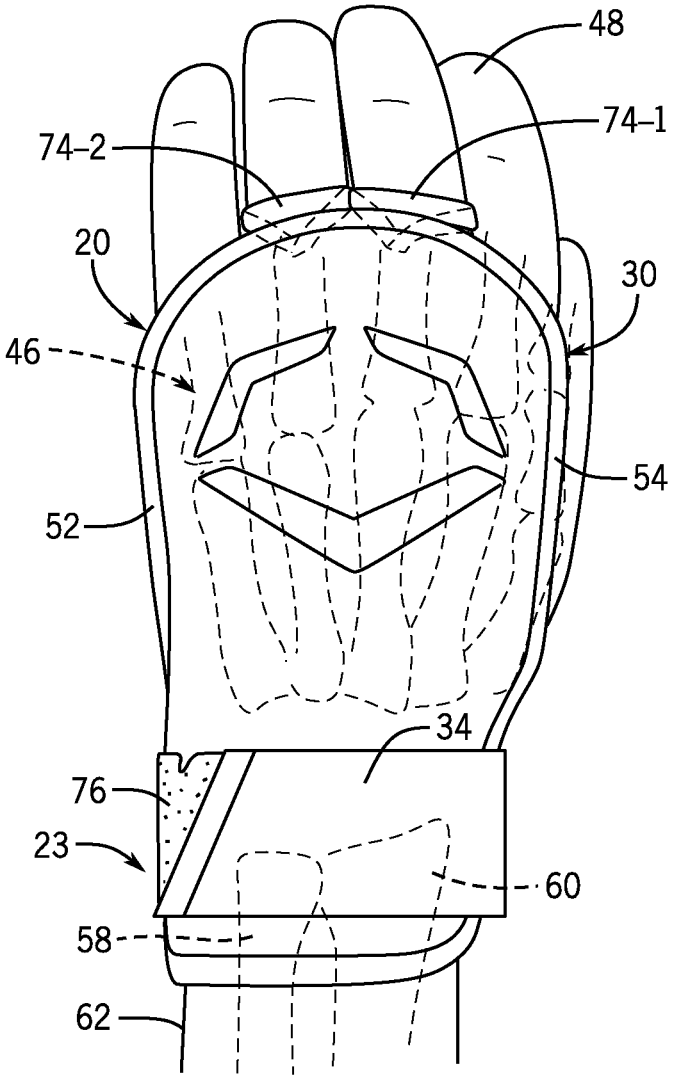
FIG. 5 is a perspective view of the front side of the batter hand guard of FIG. 2 while being worn by batter.

FIGS. 2-5 illustrate the example batter hand guard 20 in more detail. FIGS. 2 and 3 illustrates batter hand guard 20 in a closed state without an inserted hand. FIG. 4 illustrates batter hand guard 20 in an opened state, ready to receive a batter's hand. FIG. 5 is a close-up view of the batter hand guard 20 positioned on person's (batter's) hand. Batter hand guard 20 comprises a generally L-shaped protective portion 30, finger retainer 32 and wrist strap 34.

Protective portion 30 covers and protects the batter's hand and wrist. Protective portion 30 is configured to extend along and cover a back side of the batter's hand, opposite the palm side of the batter's hand, a backside of the batter's wrist and an ulna side of the batter's wrist. The ulna side of the batter's wrist is that side which is generally aligned with the pinky finger of the batter's hand. In contrast, the radial side of the batter's wrist is generally aligned with the batter's index finger. Protective portion 30 comprises hand back portion 40, wrist back extension 42 and wrist side extension 44.

Hand back portion 40 is configured to extend over the backside of the hand 48, covering at least the metacarpal bones 46 of the ring finger, the middle finger and the index finger. In the example illustrated, hand back portion 40 is configured to extend over the backside of the hand 48, covering the metacarpal bones of each of the pinky, ring, middle and index fingers. As shown by FIG. 4, hand back portion 40 comprises an upturned or bent portion or side 52 that is configured to cover a side between the pinky finger and the ulna bone adjacent the wrist. In the example illustrated, hand back portion 40 further comprise a bent portion or side 54, opposite bent side 52 so as to form a channel or trough for receiving each of the pinky, ring, middle and index fingers therebetween with bent side 54 extending along a side of the batter's index finger. In other implementations, side 54 may not be bent.

Wrist back extension 42 extends from hand back portion 40 in a longitudinal direction (towards the batter's elbow when hand guard 20 is being worn). Wrist back extension 42 is configured to cover a back of the ulna 58 and a back of a radius 60 joined to hand 48 at the wrist. Wrist back extension 42 generally extends from the batter's wrist towards the batter's elbow. In some implementations, the wrist back extension 42 has a first width and wherein the hand back portion 40 has a second width greater than the first width. In some implementations, the hand back portion 40 and the wrist back extension 42 have a combined length of at least 4 inches. In some implementations, the hand back portion 40 has an unbent width of at least 4 inches Wrist side extension 44 extends sideways from wrist back extension 42, projecting laterally beyond side 52 of hand back portion 40. Wrist side extension 44 has a curled or curved shape so as to extend about or around the ulna side 23 of the batter's wrist, forming a channel 64 that receives the ulna side of the batter's wrist. Wrist side extension 44 has an un-curled length (those portions projecting beyond side 52) of at least 1 inch. The wrist side 44 extension can extend beyond the hand back portion 40 by at least 1 inch.

Wrist side extension 44 is configured to reduce the transmission of dense impact forces to the batter's wrist. Wrist side extension 44 is sufficiently rigid or hard to provide the hard shell that experiences minimal compression upon impact and disperses or spreads such impact forces. In some implementations, wrist side extension 44 is formed from a hardened material. In some implementations, the hardenable material is a gel that hardens when exposed to air. In other implementations, wrist side extension 44 may be formed from other materials.

As shown by broken lines in FIG. 4, in the example illustrated, protective portion 30 is formed by a single continuous, uninterrupted panel 70 of homogenous material having an L-shape. Panel 70 is surrounded or encased by an outer encasement 72. In the example illustrated, outer encasement 72 is formed by a flexible thin material such as a fabric material or thin panels or sheet a polymeric material. In some implementations, outer encasement 72 is formed from a fabric material that absorbs perspiration and that is resistant to mildew and odor. In other implementations, the outer encasement 72 can be formed of a breathable textile material. In some implementations, outer encasement 72 may have other configurations or may be omitted. In some implementations, the encasement can include a mesh material to provide additional comfort to the player, as well as moisture wicking properties.

In some implementations, protective portion 30 may alternatively be formed for multiple distinct sub-panels of rigid material which are held together by outer encasement 72. In such implementations, the gaps between the adjacent subpanels provide pivotable joints or hinges. In some implementations, protective portion 30 may comprise a single continuous or uninterrupted panel 70, but wherein selected portions or lines of panel 70 are thinner to facilitate pivoting or to provide living hinges.

Figure 6:
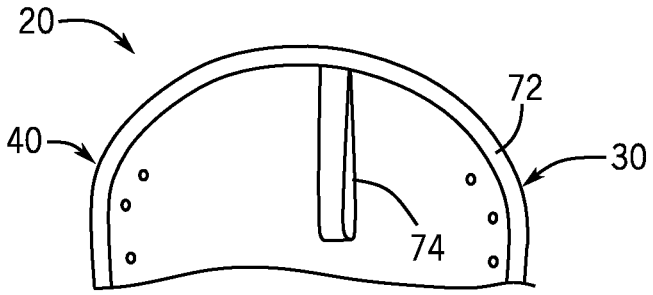
FIG. 6 is a fragmentary perspective view of the batter hand guard of FIG. 3 with an alternative finger retainer.

Finger retainer 32 comprises a structure connected to protective portion 30 proximate an end of hand back portion 40, wherein the structure is configured to at least partially receive at least one finger of the batter to position and retain batter hand guard 20 on the batter's hand. In the example illustrated, finger retainer 32 comprises a pair of loops 74-1 and 74-2 (collectively referred to as loops 74). As shown by FIG. 5, loop 74-1 is to receive the batter's ring finger while loop 74-2 is to receive the batter's middle finger. In some implementations, loops 74 are formed from a fabric material connected to outer encasement 72 by stitching. In other implementations, loops 74 may be formed from other materials and may be secured to outer encasement 72 or to panel 70 in other fashions. As shown by FIG. 6, in some implementations, finger retainer 32 may comprise a single loop 74 configured to receive one or more fingers of the batter's hand such as the batter's index, middle and/or ring finger.

Wrist strap 34 comprises an elongate band of flexible or bendable material configured to wrap about the batter's wrist not covered by wrist side extension 44. In the example illustrated, wrist strap 34 extends from an end portion of wrist side extension 44 and is configured to overlap the back face of wrist back extension 42, releasably connected to the back of wrist back extension 42. In the example illustrated, the back of wrist strap extension 42 comprises a first portion 76 of a hook and loop fastener, such as Velcro®, whereas wrist strap 34 carries a second portion 78 of the hook and loop fastener. In other implementations, the free end of wrist strap 34 may be releasably connected to wrist back extension 42 of protective portion 30 using other forms of a fastener. In other implementations, in lieu of extending from wrist side extension 44, wrist strap 34 may extend from a location proximate to the opposite side of protective portion 30, a portion extending from a location proximate to side 54, whereas the free end of strap 34 first overlaps wrist side extension 44 before being releasably connected to protective portion 30.

In the example illustrated, wrist strap 34 is formed from an inelastic band of fabric material. In other implementations, wrist strap 34 may be formed from a band of elastic fabric material. In still other implementations, wrist strap 34 may be formed from an elastic or inelastic polymer. In some implementation wrist strap 34 may comprise a continuous extension of outer encasement 72.

FIGS. 7-11 illustrate an example batter hand guard 120. Batter hand guard 120 is similar to batter hand guard 20 described above except that batter hand guard 120 comprises protective portion 130 in place of protective portion 30. The remaining components of batter hand guard 120, which correspond to components of batter hand guard 20, are numbered similarly.

Protective portion 130 is similar to protective portion 30 described above except that protective portion 130 comprises a wrist side extension 144 that is specifically formed from a material that is moldable and hardenable while the wrist side extension 144 is wrapped about the batter's ulna from the backside to the palm side of the forearm. In the example illustrated, hand back portion 40, wrist back extension 42, and wrist side extension 44 are formed from a single continuous, uninterrupted panel 170 of a material that is moldable and hardenable while being wrapped about and positioned the batter's hand and wrist. As with panel 70 of hand guard 20, panel 170 of hand guard 120 is encased by outer encasement 72.

In some implementations, the material used to form wrist side extension 44, and in some implementations, hand back portion 40 and/or wrist back extension 42, comprises a gel-like material that hardens upon exposure to a catalyst or stimulus, such as air, otherwise referred to a Gel-to-Shell® material from Evoshield®. The gel-like material is an activated material that transforms the panel 70 or panel 170 from a malleable gel into a customized, form fitting shield in minutes. The gel-like material gives the player a customized, one-to-one fit, and providing the player with optimum protection. The panel 70, when hardened, spreads force across the surface of the panel 70 when impacted by a pitched ball, thereby minimizing felt pressure on the point of impact. In some implementations, the material is configured to change from a soft flexible state to a rigid hardened state in less than 30 minutes at room temperature or at an outside ambient temperate temperature, such as at a temperature of less than 80° F. and greater than 40° F.

In some implementations, the material is configured to change from a soft flexible state to a rigid hardened state in response to a stimulus or catalyst. In some implementations, the stimulus or catalyst is one that is tolerable person or batter while wearing the batter hand guard. In some implementations, the material is configured to change state in response to exposure to air at the aforementioned temperatures. In other implementations, the material may be configured to change state in response to other stimuli or combination of stimuli which are also tolerable to a person or batter while wearing the batter hand guard and which facilitate my soft flexible state to a hard rigid state in less than one hour and nominally less than 30 minutes.

In the example illustrated, the material comprises a gel-to-shell material. The gel-to-shell material begins soft and flexible, but chemical components initiate hardening upon exposure to air, such as upon removal of the hand guard 120 from a foil bag or such as upon sufficient bending so as to break an airtight encasement enclosing the material of panel 170 (within outer encasement 72. In approximately 20 to 30 minutes, the once soft material transforms into hard protective guard permanently molded to a desired shape. During the 20 to 30 minutes prior to hardening, the material may be shaped and molded about portions of the batter's hand and wrist. In other implementations, the material used to form protective portion 130 may comprise other compositions that may be molded about and against a person's hand and wrist while in a soft flexible state and that may be subsequently hardened to a force dispersing rigid shell upon a triggering event such as exposure to air, exposure to water and/or exposure to heat, wherein such exposure is tolerable to the hand and wrist of the batter as the hand guard is being hardened while being worn by the batter.

Figure 7:
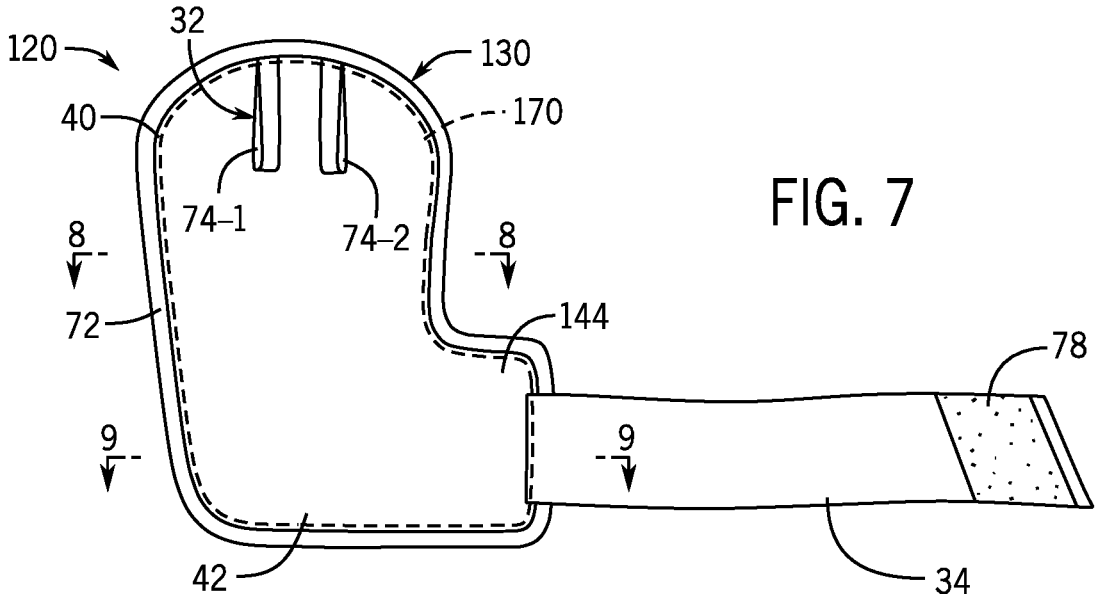
FIG. 7 is a perspective view of a backside of an example batter hand guard prior to customized shaping and hardening of the batter hand guard.
Figure 8:
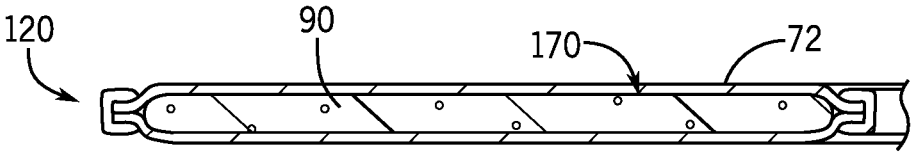
FIG. 8 is a sectional view of the batter hand guard of FIG. 7 taken along line 8-8.
Figure 9:
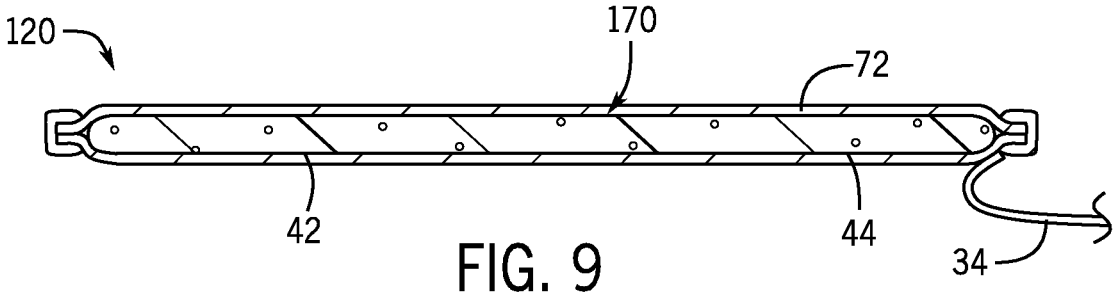
FIG. 9 is a sectional view of the batter hand guard of FIG. 7 taken along line 9-9.
Figure 10:
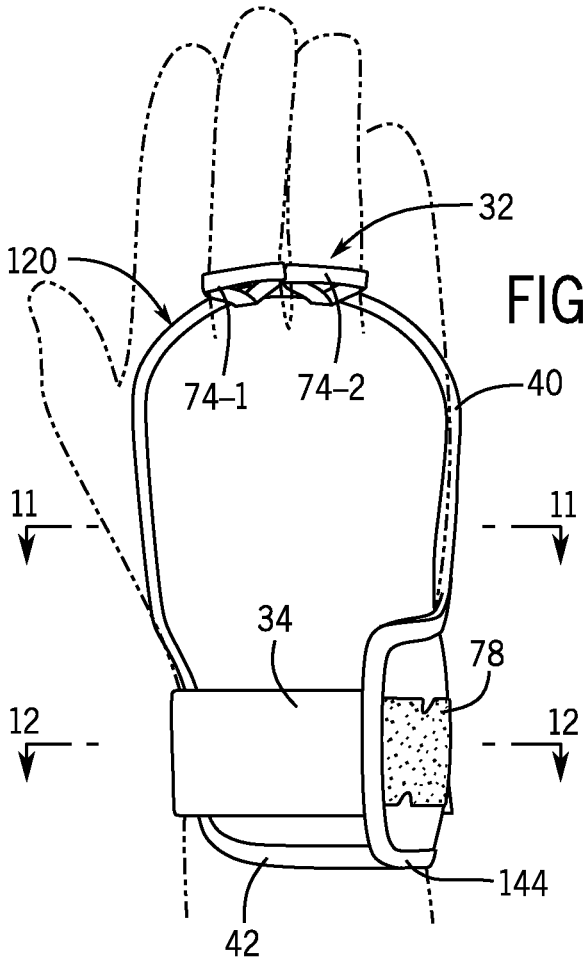
FIG. 10 is a perspective view of the backside of the batter hand guard of FIG. 7 shaped to a hand while being worn by the hand and subsequently hardened to a fixed customized shape.
Figure 11:
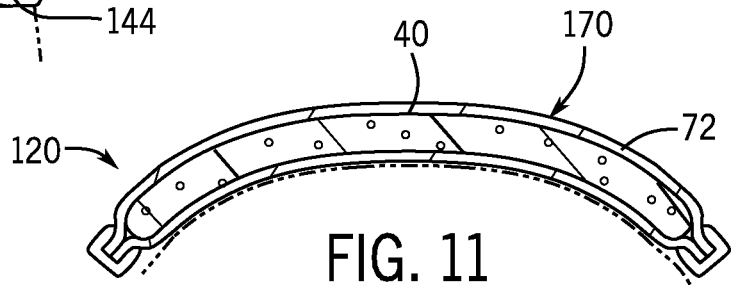
FIG. 11 is a sectional view of the batter hand guard of FIG. 10 taken along line 11-11.
Figure 12:
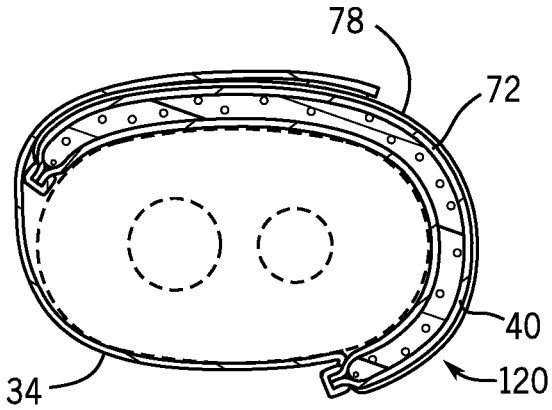
FIG. 12 is a sectional view of the batter hand guard of FIG. 10 taken along line 12-12.

FIGS. 7-9 illustrate batter hand guard 120 prior to molding and hardening of wrist side extension 144 and panel 170. FIGS. 10-12 illustrate batter hand guard 120 following molding and hardening of batter hand guard 120 about and against the batter's hand. As shown by FIG. 12, once wrapped about the batter's wrist and allowed to harden upon exposure to a stimulus or catalyst (such as upon exposure to air), wrist side extension 144 has a permanent retained shape chosen by the batter. The batter may choose a shape which closely conforms to the batter's wrist. This permanent shape may more securely and snuggly retain its position upon the batter's wrist for proper positioning and alignment. The shape may be less susceptible to inadvertent movement out of proper positioning. The customize shape may further facilitate more consistent and repeatable positioning of batter hand guard 120 about the batter's wrist.

Figure 12A:
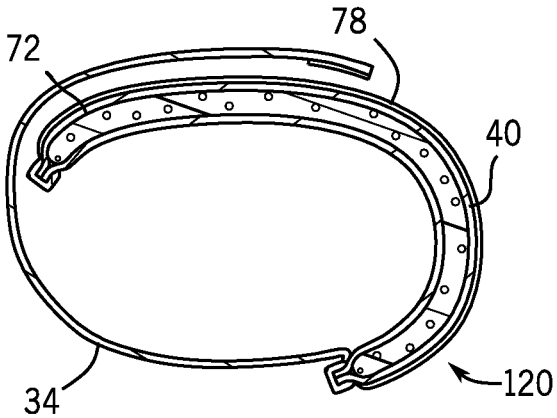
FIG. 12A is a sectional view of the batter hand guard of FIG. 7 shaped to a second hand while being worn by the second hand and subsequently hardened to a second fixed customized shape different than the fixed customized shape shown in FIG. 12.

FIG. 12A illustrates batter hand guard 120 following the molding and hardening of batter hand guard 120 about and against a hand of a different batter or second batter having a differently sized hand and wrist. FIG. 12A illustrates the same batter hand guard 120 molded to a different hardened or permanent shape that conforms to the second batter. As demonstrated, batter hand guard 120 facilitates a customized shape and fit for different batters, wherein the customized shape may be conveniently achieved by shaping the hand guard on the field, in the dugout, or elsewhere in a relatively short period of time (less than one hour and nominally less than 30 minutes).

Figure 13:
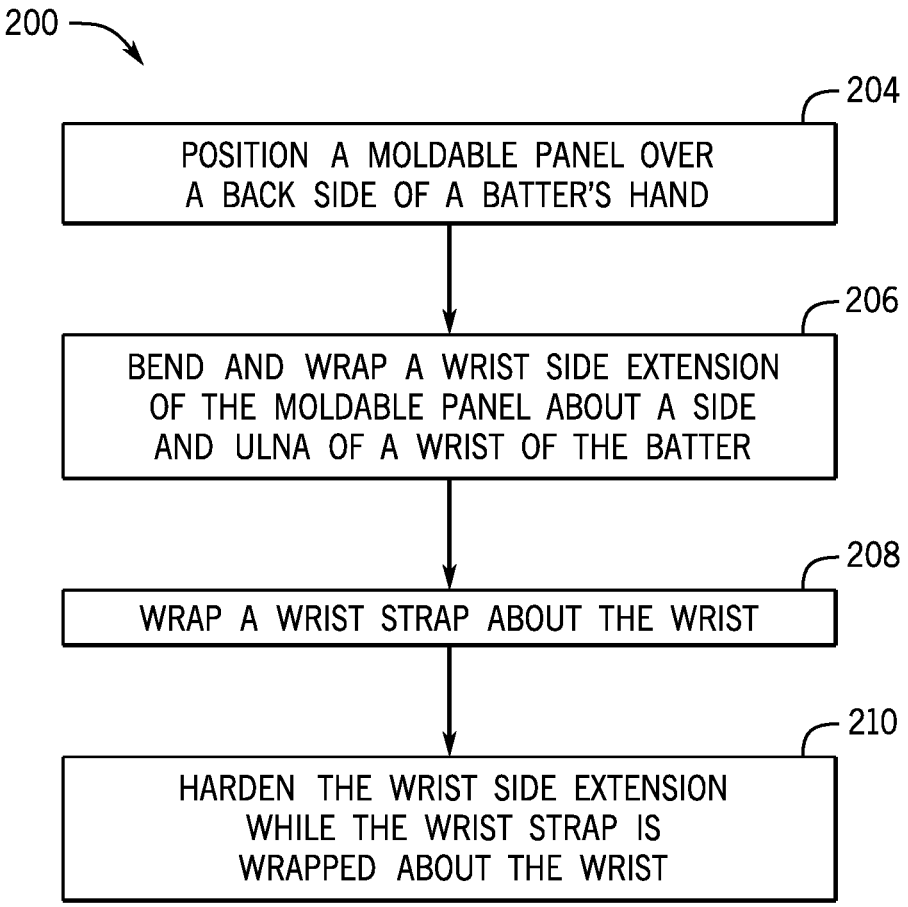
FIG. 13 is a flow diagram of an example method for customizing a batter hand guard.

FIG. 13 is a flow diagram of an example method 200 of customizing a batter hand guard, such as batter hand guard 120. As indicated by block 204, a moldable panel is positioned over a backside of a batter's hand. An example panel is moldable panel 70 or panel 170 described above. In some implementations, the moldable panel may be encased by an outer encasement 72 as described above. In some implementations, the outer encasement 72 may be omitted or the moldable panel may not be completely encased by the outer encasement 72.

In some implementations, the moldable panel is positioned over the backside of the batter's hand such that a hand back portion covers at least metacarpal bones of ring, middle and index fingers of the hand on the backside of the hand. The moldable panel is further positioned such that a wrist back extension extending from the hand back portion covers a back of an ulna and a back of a radius of the forearm.

As indicated by block 206, a wrist side extension of the moldable panel is bent and wrapped about a side and ulna of a wrist of the batter. FIGS. 10-12 illustrate an example of a wrist side extension being wrapped about a side and ulna of a wrist of a batter. FIG. 12A illustrates an example of the wrist side extension of the moldable panel being bent and wrapped about a side and ulna of a wrist of a second different batter.

As indicated by block 208, a wrist strap, coupled to the moldable panel, is wrapped about the wrist of the batter. FIG. 10 illustrates an example of the wrist strap being wrapped about the wrist of the batter. In the example illustrated, the wrist strap extends from the wrist side extension. In other implementations, the wrist strap may extend from an opposite side of the batter hand guard, extending over and across the wrist strap extension. The wrist strap may assist in maintaining the molded shape of the wrist side extension until the material of the wrist side extension has sufficiently hardened to maintain its shape on its own without the assistance of the wrist strap.

As indicated by block 210, the wrist side extension is permitted to harden while the wrist strap is wrapped about the wrist. The wrist side extension is permitted to harden while the wrist side extension wrapped about a side and the ulna of the wrist of the batter. In some implementations, an entirety of the moldable panel is shaped based upon the batter's wrist and hand and is permitted to harden while being shaped against the batter's wrist and hand. In some implementations, such hardening is initiated or triggered through the application of a stimulus to the material of the moldable panel. As described above with material of panel 170, the stimulus may be in the form of exposing the material to air or another stimulus. Exposure to air can be achieved by breaking an airtight seal or enclosure about the panel 170. In some implementations, such hardening may occur at a temperature between 40° F. and 100° F. and in a time less than one hour and nominally less than 30 minutes. Thereafter, the wrist side extension will have a rigid, fixed shape customized to the shape of the batter's wrist or to a shape corresponding to the batter's preferences. The wrist side extension will form a hard shell capable of dispersing or spreading forces received from a ball or other projectile impacting the wrist side extension. By dispersing such force, the wrist side extension reduces injury to the batter's wrist.

Figure 14:
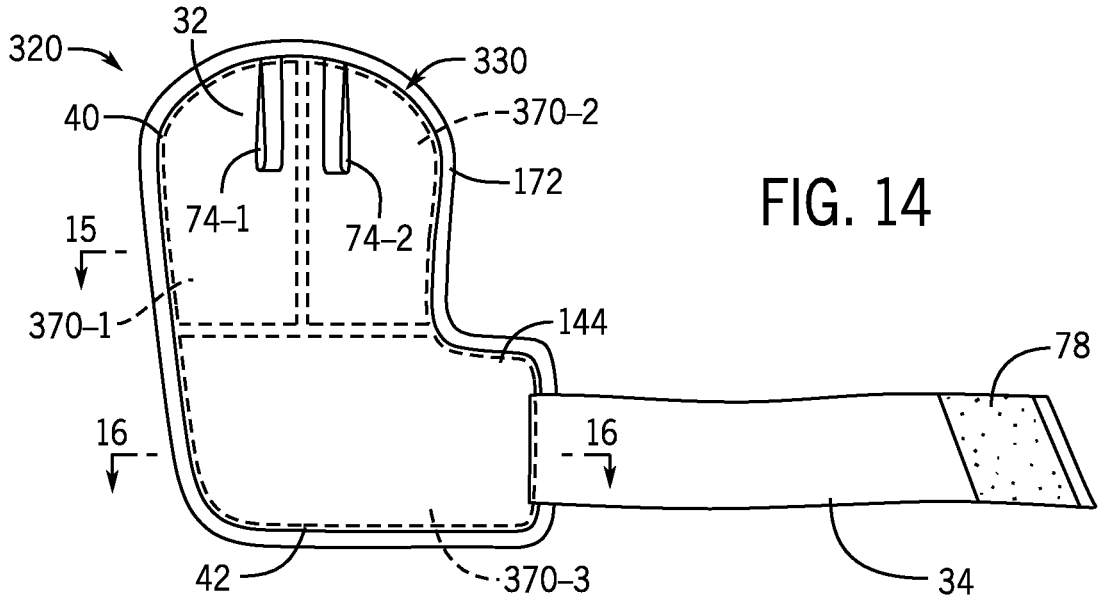
FIG. 14 is a perspective view of a backside of an example batter hand guard prior to customized shaping and hardening of the batter hand guard.
Figure 15:
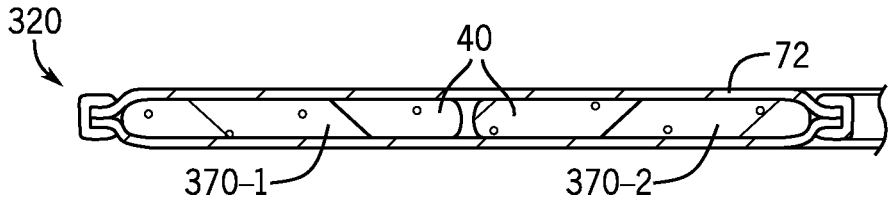
FIG. 15 is a sectional view of the batter hand guard of FIG. 14 taken along line 15-15.
Figure 16:
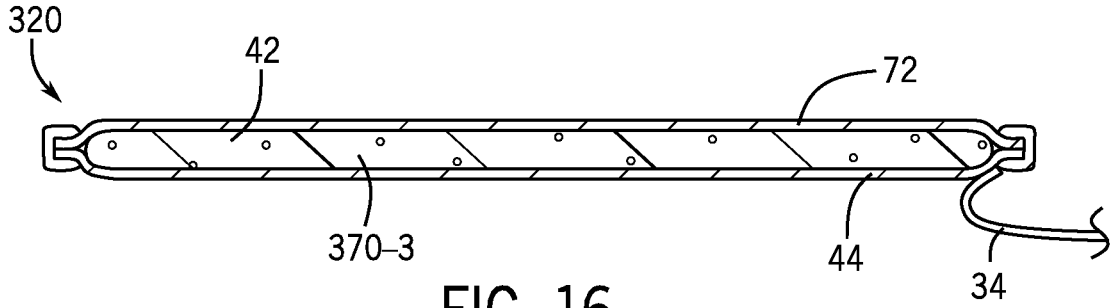
FIG. 16 is a sectional view of the batter hand guard of FIG. 14 taken along line 16-16.

FIGS. 14-16 illustrate an example batter hand guard 320 prior to hardening or permanent shaping/customization. FIGS. 14 to 16 illustrate an example of how the protective portion of a batter hand guard may be segmented into multiple sub-panels. Batter hand guard 320 is similar to batter hand guard 120 described above except that batter hand guard 320 comprises protective portion 330 in place of protective portion 130. The remaining components of batter hand guard 320 which correspond to components of batter hand guard 120 are numbered similarly.

Protective portion 330 is similar to protective portion 130 except that protective portion 330 comprises multiple distinct subpanels 370-1, 370-2 and 370-3 (collectively referred to as subpanels 370). Subpanels 370 are received within outer encasement 172. In some implementations, each of subpanels 370 are formed from the same material and have the same thickness. In some implementations, each of subpanels 370 are formed from the material described above with respect to panel 170. FIGS. 14-16 illustrate such subpanels 370 when such subpanels 370 are soft, and flexible, prior to shaping and hardening of batter hand guard 320.

In some implementations, different subpanels 370 may have different pre-hardening and/or post hardening characteristics. For example, in some implementations, different subpanels 370 may be formed from different materials and/or may have different thicknesses. As a result, the different subpanel 370 may provide different degrees of protection and different relative weights to enhance protection and enhance batter performance. Panel 370-1, facing away from a thrown ball or projectile, may be provided with a lower degree of thickness, a lower degree of rigidity as compared to subpanels 370-2 and 370-3. In some implementations, subpanel 370-2 may remain soft and flexible when batter hand guard 320 is used during an at-bat, whereas subpanels 370-2 and 370-3 are rigid and hardened.

In the example illustrated, hand back portion 40 is formed by subpanels 370-1 and 370-2. Wrist back extension 42 and wrist side extension 44 are formed by a single continuous uninterrupted subpanel 370-3. In the example illustrated, the individual distinct subpanels 370 are held together by outer encasement 172 which is formed from a flexible or bendable material. As a result, each of subpanels 370 are pivotable relative to one another by a hinge formed from the flexible fabric or other flexible material of outer encasement 172. Such hinges provide batter hand guard 320 with enhanced flexibility even following hardening of wrist side extension 144 and any of the other subpanels 370 forming protective portion 330. In some implementations, adjacent subpanels 370 may not be distinct and may be formed from a continuous panel, wherein the adjacent subpanels formed from the continuous panel are separated by a thinned region of the continuous panel or a region of the continuous panel which is not hardened (not exposed to a stimulus) such that the adjacent panels formed from the continuous panel are pivotable relative to one another about the thinned or non-hardened seams/joints during use of batter hand guard 320 during an at-bat.

Although batter hand guard 320 is illustrated as having a protective portion 330 formed from the illustrated three subpanels 370, in other implementations, batter hand guard 320 may have a protective portion 330 formed from a greater or fewer number of such subpanels 370 having other sizes and shapes. For example, in some implementations, subpanel 370-3 may be segmented into two distinct subpanels with a first subpanel forming wrist back extension 42 and a second distinct panel forming wrist side extension 144, wherein the two subpanels are joined by a hinge even following hardening of the two subpanels. In some implementations, subpanels 370-1 and 370-2 may alternatively be formed from a single continuous panel.

In the example illustrated, batter hand guard 320 is configured to be molded and hardened while being worn by the batter or after wrist side extension 144 has been wrapped about a side of the wrist of the batter to a desired shape. For example, batter hand guard 320 may be molded to a shape similar to that shown in FIGS. 10-12 and then exposed to a stimulus (such as air) to harden to a permanent rigid shape.

In other implementations, batter hand guard 320 and wrist side extension 144 are preformed and have a predefined shape prior to ever being worn by the batter. In such implementations, the wrist side extension may be formed from a material that hardens in response to stimulus that would not be tolerable to a person or over a period of time greater than an hour. In such implementations, the wrist side extension along with other portions of protective portion 330) may be molded in a mold having a particular predefined shape for the wrist side extension, wherein the material hardens while within the mold. In some implementations, the wrist side extension is molded and hardened while in a mold, wherein once removed from the mold, may be encased by an outer encasement, such as outer encasement 172. With such implementations, different batter hand guards 320 having differently shaped wrist side extensions 144 may be used by different batters having different wrist sizes or different preferences. The batter may select a particular hand guard having a particular wrist side extension shape that best matches his or her wrist or his or her preferences.

Figure 17:
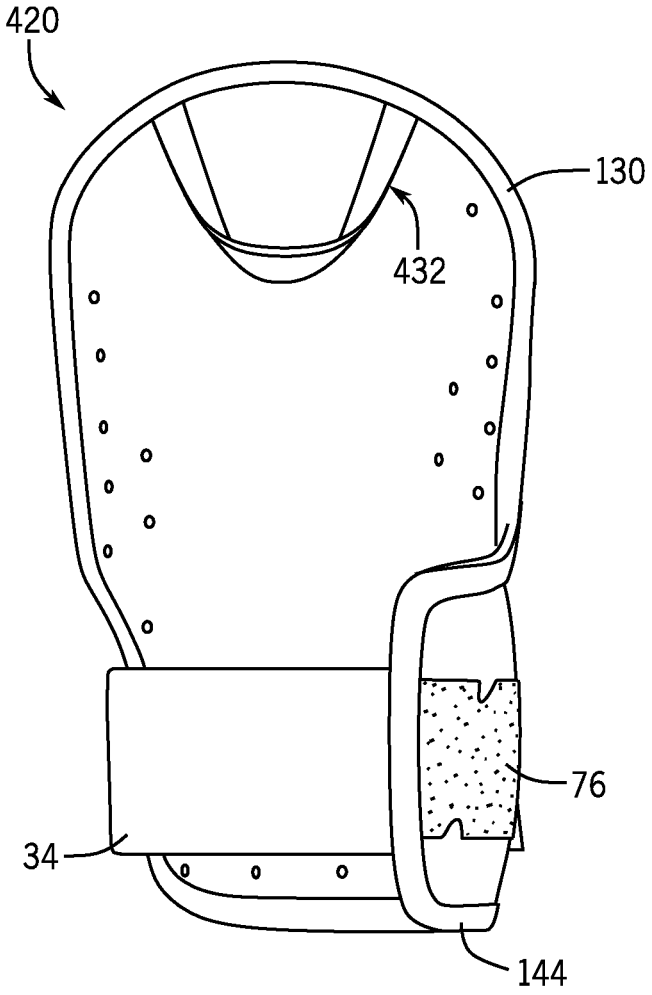
FIG. 17 is a perspective view of a backside of an example batter hand guard.

FIG. 17 illustrates an example batter hand guard 420 for a right-handed batter. Batter hand guard 520 is similar to batter hand guard 20, batter hand guard 220 and/or batter hand guard 320 in that batter hand guard 420 is either preformed in a mold (providing the wrist side extension with its curved shape) prior to being worn by a batter or is customized to the batter by having panel 170 or subpanels 370 shaped and hardened while being worn by the batter. FIG. 17 illustrates batter hand guard 420 in a hardened, rigid and fixed state or shape. Batter hand guard 520 is similar to batter hand guard 20 and batter hand guard 220 except that batter hand guard comprises finger retainer 432. Those remaining components of batter hand guard for 20 which correspond to components of batter hand guard 2420 are numbered similarly.

Finger retainer 432 comprises a single loop of flexible material extending from near a tip of protective portion 130 on the palm side of batter hand guard 420. Finger retainer 432 is sized to concurrently receive multiple fingers of the batter such as the ring and middle finger of the batters' hand. In other implementations, finger retainer 432 may have other configurations. In some implementations, finger retainer 432 may be omitted. As with batter hand guards 20, 120, and 320, batter hand guard 420 comprises a rigid hard shell forming wrist side extension 144 which forms a channel that is to receive the side of the batters' wrist, protecting the base of the metacarpal bone of the pinky and the ulna bone of the wrist or forearm which face and oncoming pitched ball or other projectile.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A batter hand guard for being worn by a hand joined to a forearm by a wrist joint, the hand and the forearm having a palm side and a back side opposite the palm side, the hand comprising a thumb, a pinky, a middle finger, an index finger and a ring finger, the batter hand guard comprising:

a hand back portion configured to cover at least metacarpal bones of the ring finger, the middle finger, and the index finger of the hand on the back side of the hand, wherein the hand back portion comprises a moldable and hardenable material;

a wrist back extending from the hand back portion and configured to cover a back of an ulna and a back of a radius of the forearm, wherein the wrist back extension comprises a moldable and hardenable material; and a wrist side extension extending sideways from the wrist back extension, the wrist side extension comprising a moldable and hardenable material configured to wrap about the ulna from the back side to the palm side of the forearm, wherein the wrist back extension and the wrist side extension are integrally formed as a single unitary panel;

a finger retainer extending from the hand back portion and configured to receive at least one of the middle, index and ring fingers of the hand; and a flexible wrist strap extending from the wrist side extension, the flexible wrist strap being releasably connectable to a back of the wrist back extension.

2. The batter hand guard of claim 1, wherein the hand back portion, the wrist back extension and the wrist side extension are integrally formed as the single unitary panel.

3. The batter hand guard of claim 2 further comprising an outer encasement enclosing the single unitary panel.

4. The batter hand guard of claim 3, wherein the outer encasement is formed from a fabric material.

5. The batter hand guard of claim 2, wherein the wrist back extension has a first width and wherein the hand back portion has a second width greater than the first width.

6. The batter hand guard of claim 5, wherein hand back portion comprises a bent side portion configured to cover a side of the hand between the pinky and the ulna.

7. The batter hand guard of claim 1, wherein the wrist side extension extends beyond the hand back portion by at least 1 inch.

8. The batter hand guard of claim 1, wherein the hand back portion and the wrist back extension have a combined length of at least 4 inches.

9. The batter hand guard of claim 1, wherein the hand back portion has an unbent width of at least 4 inches.

10. The batter hand guard of claim 1, wherein the wrist side extension extends from a first side portion of the wrist back extension and has a terminal edge sufficiently spaced from a second side portion of the wrist back extension to facilitate sideways insertion of the wrist joint between the terminal edge and the second side portion of the wrist back extension.

11. The batter hand guard of claim 1, wherein the moldable and hardenable material is moldable while being positioned on the hand and subsequently hardenable while positioned on the hand.

12. The batter hand guard of claim 1, wherein the hand back portion is configured to be disengaged from the thumb so as to not encircle the thumb, facilitating articulation of the thumb relative to the backhand portion.

13. The batter hand guard of claim 1, wherein the wrist side extension is configured so as to terminate along an edge on a pinky side of the index finger to form a wrist opening sized to sideways receive a wrist following hardening of the wrist side extension.

14. The batter hand guard of claim 1, wherein the hand back portion comprises a second single unitary panel of a moldable and subsequently hardenable material, the second single unitary panel being distinct from the single unitary panel.

15. The batter hand guard of claim 14, wherein the single unitary panel and the second single unitary panel have different pre-hardening and/or post hardening characteristics.

16. A batter hand guard comprising:

a single unitary panel formed from a moldable and bendable material and having an L-shape, the single unitary panel comprising a hand back portion, a wrist back extension extending from the hand back portion, and a wrist side extension extending sideways form the wrist back extension;

an encasement about the panel;

a finger retainer connected to the encasement proximate an end of the hand back portion; and a wrist strap extending sideways from the wrist side extension for wrapping about a wrist, wherein wrist side extension is moldable for wrapping the wrist strap extension about a side of an anatomical wrist and is hardenable for retaining a wrapped shape corresponding to a shape of the wrist.

17. The batter hand guard of claim 16, wherein side portions of the panel forming the hand back portion are moldable for forming a trough shape about an anatomical hand and are hardenable to retain the trough shape.

18. A batter hand guard comprising:

a protective portion having an L-shape, the protective portion comprising a hand back portion, a wrist back extension extending from the hand back portion, and a wrist side extension extending sideways form the wrist back extension;

a finger retainer connected to the hand back portion; and a wrist strap extending sideways from the wrist side extension for wrapping about a wrist, wherein wrist side extension is rigid along its entirety and is curved to receive a side of the wrist, the side extension having a terminal edge sufficiently spaced from the wrist back extension to facilitate sideways insertion of the wrist between the terminal edge and the wrist back extension.

19. The batter hand guard of claim 18, wherein the L-shape of the protective portion is formed from a single unitary panel member.

20. The batter hand guard of claim 18, wherein the wrist side extension is formed from a moldable and subsequently hardenable material.

21. The batter hand guard of claim 20, wherein the wrist side extension is coplanar with the wrist back extension and the hand back portion prior to being molded and hardened while being wrapped about a batter's wrist.

22. The batter hand guard of claim 18, wherein the hand back portion, the wrist back portion and the wrist side extension are integrally formed as a single unitary panel and are rigid across the entirety of the panel.

23. The batter hand guard of claim 22, wherein, the batter hand guard does not encircle the thumb, facilitating articulation of the thumb relative to the batter hand guard.

* * * * *